US006447337B1

(12) United States Patent
Anderson et al.

(10) Patent No.: US 6,447,337 B1
(45) Date of Patent: Sep. 10, 2002

(54) ELECTRICAL CONNECTOR ASSEMBLY WITH REMOVABLE FILTER BLOCK

(75) Inventors: John David Anderson, Hemel Hempstead (GB); Peter Dent, Enfield (GB); Paul Hynes, Watford (GB)

(73) Assignee: Smiths Industries Public Limited Company (GB)

( * ) Notice: Subject to any disclaimer, the term of this patent is extended or adjusted under 35 U.S.C. 154(b) by 0 days.

(21) Appl. No.: 09/488,685

(22) Filed: Jan. 21, 2000

(30) Foreign Application Priority Data

Feb. 23, 1999 (GB) ..... 9903970

(51) Int. Cl.[7] ..... H01R 13/66; H01R 33/945; H01R 13/648

(52) U.S. Cl. ..... 439/620; 439/608

(58) Field of Search ..... 439/620, 95, 607, 439/608

(56) References Cited

U.S. PATENT DOCUMENTS 4,699,590 A 10/1987 Farrar et al.
4,773,880 A 9/1988 Sutton et al.
4,932,902 A * 6/1990 Crane et al. ..... 439/627
5,046,968 A 9/1991 Baur et al.
5,219,296 A 6/1993 Nguyen
5,306,180 A * 4/1994 Buhr ..... 439/620
5,647,766 A * 7/1997 Nguyen ..... 439/620
5,842,872 A * 12/1998 Hosler, Sr. et al. ..... 439/63
6,019,627 A * 2/2000 Embo et al. ..... 439/412

FOREIGN PATENT DOCUMENTS

GB 2137436 10/1984

* cited by examiner

*Primary Examiner*—Khiem Nguyen
*Assistant Examiner*—Chandrika Prasad
(74) *Attorney, Agent, or Firm*—Connolly Bove Lodge & Hutz LLP

(57) ABSTRACT

An electrical connector has a forward assembly with an outer metal housing supporting several insulative blocks containing the connector contacts. The rear end of each contact has a socket into which is inserted the forward end of conductors contained in a rear assembly. Some of the conductors are filtered and others unfiltered. Connection is made to the rear end of the conductors in the rear assembly by means of plates connected at the end of a cable, the plates supporting contacts that are a push-fit in the rear of the conductors in the rear assembly.

9 Claims, 4 Drawing Sheets

ELECTRICAL CONNECTOR ASSEMBLY WITH REMOVABLE FILTER BLOCK

BACKGROUND OF THE INVENTION

This invention relates to electrical connector assemblies.

Multi-contact electrical connector assemblies often have a combination of filtered contacts and unfiltered contacts. The contacts are exposed at the front of the assembly and formed with plug or socket elements so that they can make electrical contact with a cooperating push-fit connector. Electrical connection is made to the rear of the assembly by means of a cable or the like having wires soldered to the rear ends of individual ones of the contacts. Those contacts that are filtered extend only a short distance from the front surface of the assembly and are terminated at their rear ends by sockets so that filters can be plugged into the sockets. The filters extend rearwardly and the wires of the cable are soldered to the filter termination so that signals to or from the contact pass through the filter. The unfiltered contacts extend from the front to the rear face of the assembly. The connector assemblies usually have an outer rectangular shell of metal and may be mounted in a rectangular aperture in an electrical equipment housing. Conventional connector assemblies are difficult to service and to modify. The filters used in conventional connector assemblies add to the depth of the overall assembly, making the unfiltered contacts very long and prone to damage, and occupying space within the equipment housing.

BRIEF SUMMARY OF THE INVENTION

It is an object of the present invention to provide an alternative electrical connector assembly.

According to the present invention there is provided an electrical connector assembly including a forward assembly supporting a plurality of electrical contact elements, the forward end of the contact elements being exposed on the front of the assembly for connection to a cooperating connector and being provided with mating formations at their rear ends, the connector assembly including a rear assembly engageable with the rear of the forward assembly, the rear assembly including a plurality of electrical conductor elements, one for each of said contact elements, and the forward end of the conductor elements being arranged to mate with the mating formations at the rear of the contact elements, some conductor elements including filters and other conductor elements being unfiltered.

The mating formation at the rear end of each contact element is preferably a socket. The forward assembly preferably has an outer metal housing and the contact elements may be supported in an insulative block within the housing of the forward assembly, the block preferably being inserted from the rear of the housing. The forward assembly may include a metal frame clamping the block with the housing. The forward and rear assemblies may be secured together by threaded members. The rear end of the conductor elements is preferably adapted to make a push-fit connection with cooperating contacts on a plate connected at an end of a cable. The forward assembly may have a flange towards its forward end arranged to abut a forward surface of a planar member. The forward assembly may have a coding formation adapted to restrict mating with the assembly to connectors with a cooperating coding formation.

A connector assembly according to the present invention will now be described, by way of example, with reference to the accompanying drawings.

DETAILED DESCRIPTION OF THE PREFERRED EMBODIMENTS

Figure 1:
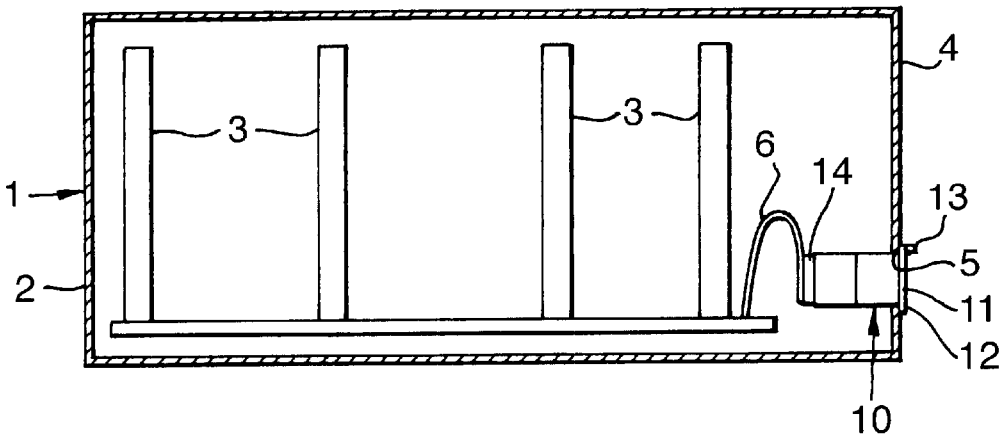
FIG. 1 is a sectional side elevation view of avionics equipment including the connector assembly.
Figure 2:
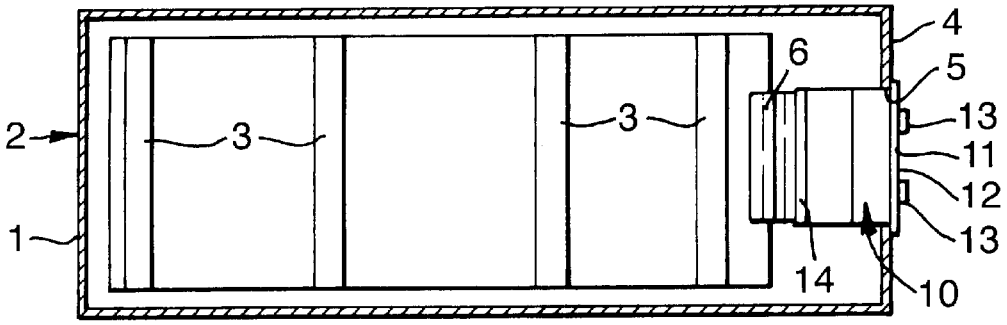
FIG. 2 is a sectional plan view of the avionics equipment.

With reference first to FIGS. 1 and 2, the avionics equipment 1 includes an outer housing 2 of rectangular shape supporting a number of vertical electronic circuit boards 3. The front face 4 of the housing 2 has a horizontal, rectangular aperture 5 through which extends a connector assembly 10. The connector assembly 10 has a radially-extending flange 11 around its front end 12, which abuts and is bolted to the front surface of the front face 4 of the housing 2. The flange 11 includes two forwardly-projecting coding key formations 13. The front end 12 of the connector assembly 10 is open to receive a mating connector (not shown) having cooperating keyways arranged to receive the keys 13. The rear 14 of the connector assembly 10 is connected to the circuit boards 3 via a flexible cable loom 6.

Figure 3:
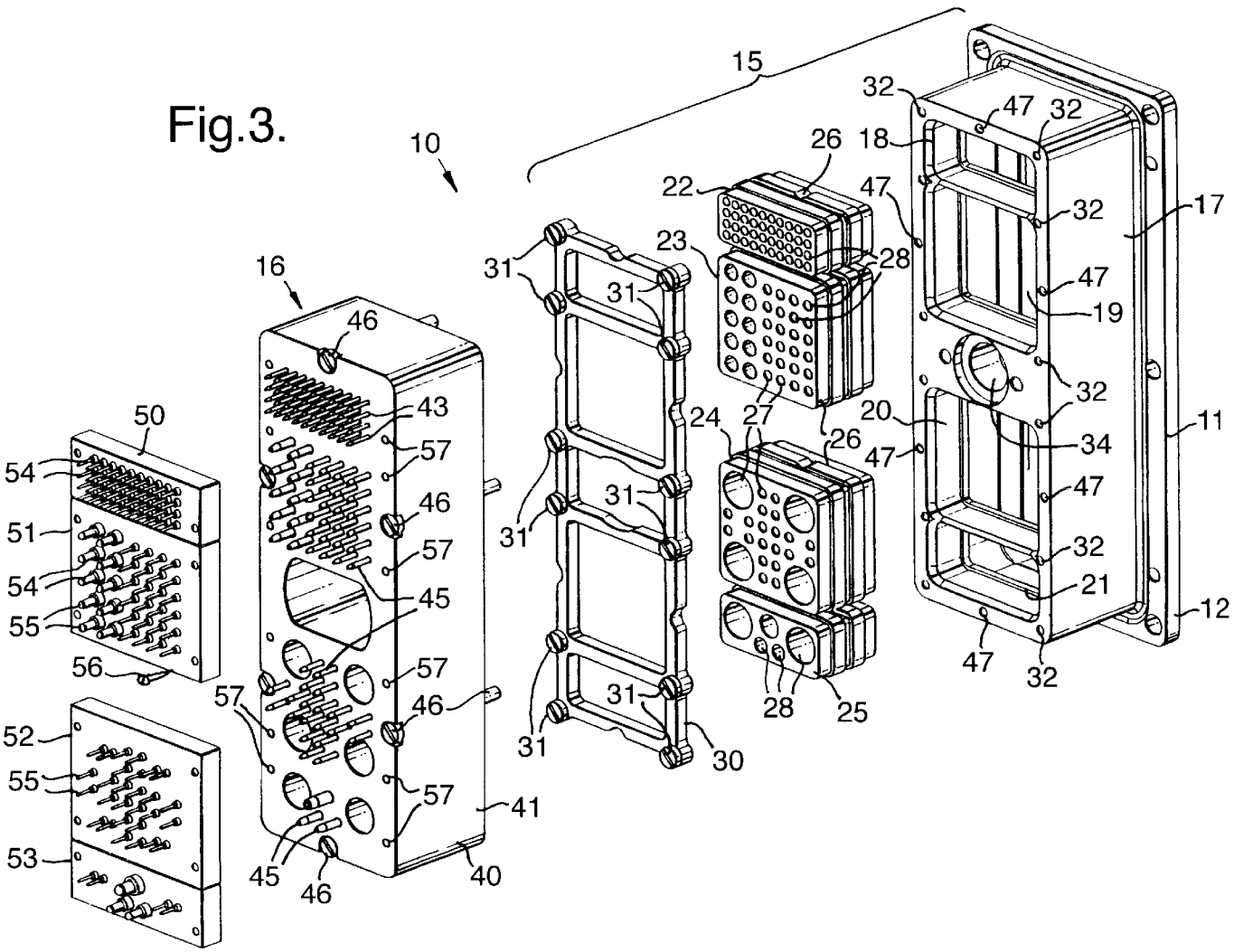
FIG. 3 is an exploded, perspective view of the connector assembly.
Figure 4:
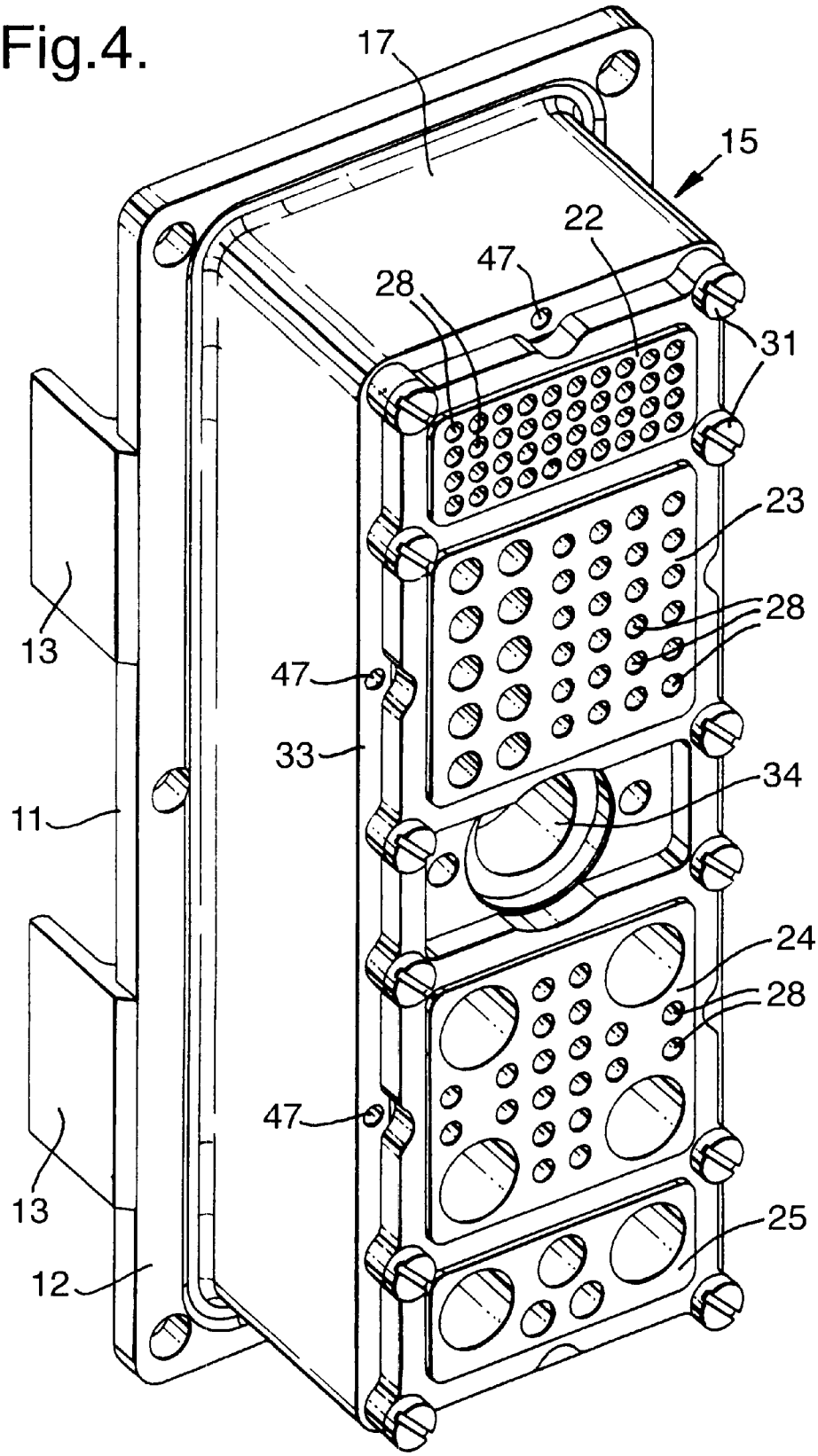
FIG. 4 is a perspective view of the rear side of a front assembly of the connector assembly.
Figure 5:
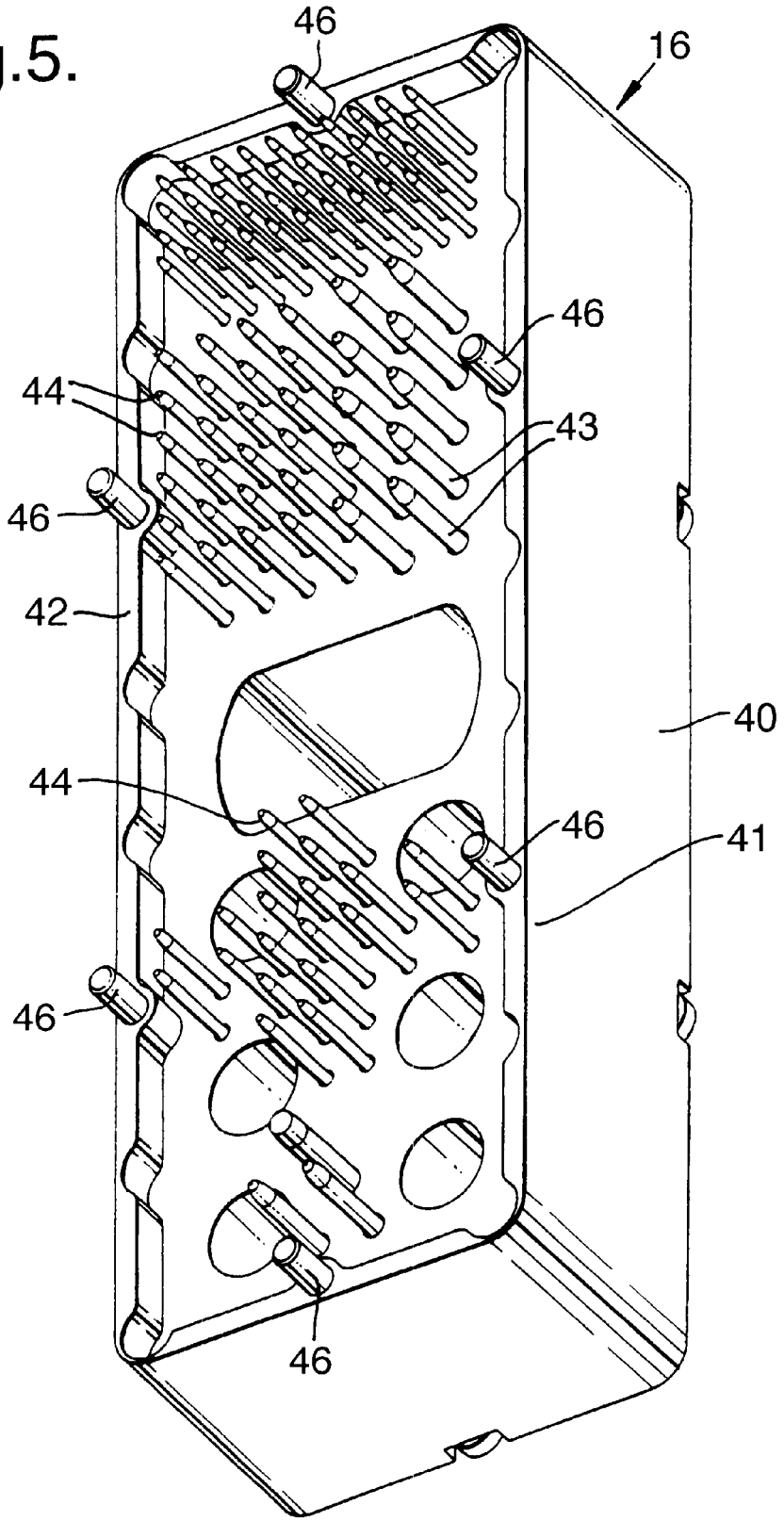
FIG. 5 is a perspective view of the front side of a rear assembly of the connector assembly.

With reference now also to FIGS. 3 to 5, the connector assembly 10 comprises a front or forward assembly 15 and a rear filter block assembly 16. The front assembly 15 has an outer metal shell 17 of rectangular shape, formed integrally with the flange 11 and keys 13 at its front end 12. The shell 17 has four recesses 18 to 21 in which are retained four insert blocks 22 to 25 respectively. Each insert block 22 to 25 comprises an electrically-insulative moulding 26 formed with passages therethrough containing respective electrical contact elements 27. Each contact element 27 has a forward end socket (not shown) and a rear end socket 28 adapted to make electrical connection with suitable contact pins. The contact elements 27 vary in size according to the function they serve. The rear surface of each terminal block 22 to 25 is thus provided with an array of sockers 28. The rear end of the terminal blocks 22 to 25 project a short distance above the end of the shell 17 and are secured in the shell by means of a metal retaining frame 30, which is fastened onto the shell by twelve screws 31 screwed into tapped holes 32 around the rear end of the shell. The external dimension of the frame 30 are such that the shell 17 projects beyond it forming a ledge 33. The shell 17 also has a central, circular hole 34 for receiving a jackscrew on the mating connector, used to retain the two connectors together.

The rear filter block assembly 16 has a metal block 40 of the same external shape as the rear of the shell 17. The forward end 41 of the block 40 is machined with a forwardly-extending peripheral collar 42; the internal shape of the collar corresponds with the external shape of the retaining frame 30, so that, when the rear assembly 16 is brought up to the rear of the front assembly 15, the collar embraces the frame and abuts the ledge 33. The block 40 has a number of passages extending therethrough, which support conductor elements 43 arranged in four groups corresponding to the four terminal blocks 22 to 25 in the front assembly 15. The forward ends 44 of the conductor elements 43 are formed into make pins of the correct size to make a sliding push fit in the sockets 28. These sockets are mating formations in that they mate with the conductor elements 43. Similarly, the rear ends 45 of the conductor elements 43 are formed into male contact pins. Some of the conductor elements 43 are simple straight-through conductors, whereas others include filtering components, such as capacitors, transient suppressors, inductors or the like, located within the block 40. Six threaded fixing screw 46 project from the front face of the rear assembly 16 around its edge and align with respective tapped hoes 47 around the rear end of the shell 17 of the front assembly 15. The rear filter block assembly 16 is assembled on the front assembly 15 by aligning the forward pins 44 of the conductor elements 43 with respective ones of the sockets 28 in the rear end of the front assembly. The screws 46 are then screwed into the tapped holes 47 so as to bring the two assemblies 15 and 16 together and ensure a metal-to-metal. contact around the edge of assemblies.

Electrical connection is made to the rear of the connector assembly by means of four header plates 50 to 53. Each header plate 50 to 53 is a solid plastics plate supporting an array of contacts 54 aligned with the rear ends of the conductor elements 43 projecting from the rear assembly block 40. The forward end of each contact 54 is formed with a socket.(not shown) into which the respective conductor element 43 is a push fit, thereby making electrical connection. The rear end of each contact 54 is formed with a solder post 55 so that wires or tracks in the flexible loom 6 can be soldered to respective posts. The header plates 50 to 53 are, therefore, secured with the flexible loom 6 and can be readily removed from the connector assembly 10 when necessary. The header plates 50 to 53 are secured with the connector assembly 10 by means of screws 56 extending through the plates and screwed into tapped holes 57 around the rear end of the rear assembly block 40.

It can be seen that the assembly of the present invention can be easily put together and taken apart when necessary. The filtered conductor elements are most prone to damage and can be replaced quickly without the need to break solder connections, simply by replacing the rear filter block assembly 16. It is often necessary to modify filtering in a connector, removing filters from some contacts and adding them to others. This can be carried out easily in the present invention simply by replacing the filter block assembly. The unfiltered contact pins of the present invention do not extend the entire depth of the connector assembly so that they can be shorter and less prone to damage.

Figure 6:
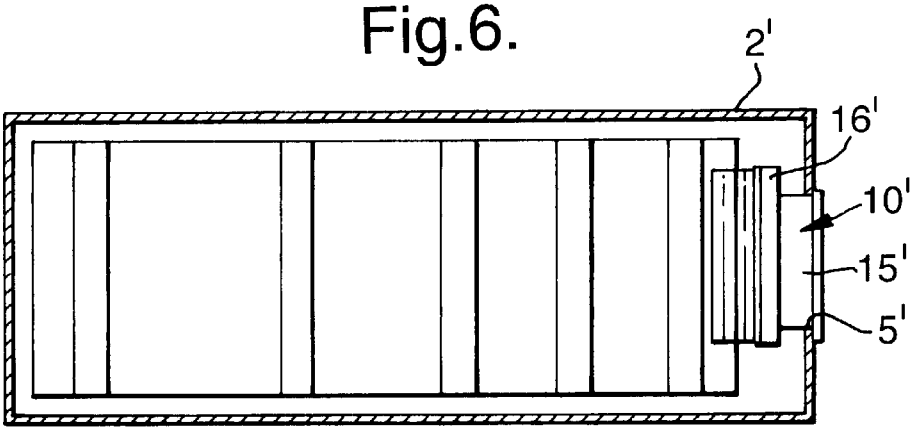
FIG. 6 is a sectional plan view of alternative avionics equipment having an alternative connector assembly.

Because the rear filter block assembly is a separate component from the front assembly, it is not essential that it be the same size and shape as the front assembly. As shown in FIG. 6, the filter block assembly 16' could be wider than the front assembly 15', thereby enabling the filter block assembly, and hence the overall depth of the connector assembly 10' to be shorter. This enables space to be created at the forward end of the housing allowing greater utilization of the available space. In such an arrangement, the forward assembly 15' would first be pushed into the aperture 5' in the housing 2' from the outside and the rear assembly 16' subsequently fitted from the inside.

What we claim is:

1. An electrical connector assembly for providing a combination of filtered and unfiltered connections, said assembly comprising: a forward assembly supporting a plurality of electrical contact elements, a forward end of said contact elements being exposed on a front of said connector assembly for push-fit connection to a cooperating connector and a rear end of said contact elements at the rear of said forward assembly being provided with mating formations; a rear assembly removably engageable with a rear of said forward assembly, said rear assembly including a plurality of electrical conductor elements extending along the length of said rear assembly, one for each of said contact elements, wherein a forward end of each conductor element is arranged to make a push-fit connection with said mating formations at the rear of said contact elements, some of said conductor elements being filtered and others of said conductor elements being unfiltered and wherein a rear end of each conductor element is exposed at the rear of said rear assembly and is arranged to make a push-fit connection with cooperating conductor elements; and a header member supporting a plurality of contacts, the forward end of each contact being a push-fit connection with the rear end of respective conductor elements on said rear assembly, such that said rear assembly is removably interposed between said forward assembly and said header member.

2. A connector assembly according to claim 1, wherein said mating formation at the rear end of each contact element is a socket.

3. A connector assembly according to claim 1, wherein said forward assembly has an outer metal housing.

4. A connector assembly according to claim 3, wherein said forward assembly includes an insulative block within said housing, wherein said block supports said contact elements, and wherein said block is inserted from a rear of said housing.

5. A connector assembly according to claim 4, wherein said forward assembly includes a metal frame clamping said block with said housing.

6. A connector assembly according to claim 1 including threaded members, and wherein said forward and rear assemblies are secured together by said threaded members.

7. A connector assembly according to claim 1, wherein said forward assembly has a flange towards its forward end arranged to abut forward surface of a planar member.

8. A connector assembly according to claim 1, wherein said forward assembly has a coding formation constructed or arranged to restrict mating with said connector assembly to connectors with a cooperating coding formation.

9. An electrical connector assembly for providing a combination of filtered and unfiltered connections, said assembly comprising: a forward assembly, said forward assembly including an outer metal housing and a plurality of insulative blocks retained in said housing, each said block supporting a plurality of electrical contact elements, a forward end of said contact elements being exposed on a front of said connector assembly for push-fit connection to a cooperating connector and a rear end of said contact elements being provided with mating formations at the rear of said forward assembly; a rear assembly removably engageable with the forward assembly, said rear assembly including a metal block adapted to made electrical connection with said housing, said metal block supporting a plurality of electrical elements extending along the length of said rear assembly, one for each of said contact elements, wherein a forward end of each conductor element is provided with push-fit formations adapted to mate with said mating formations at the rear of said contact elements, wherein a rear end of said conductor elements is provided with push-fit formations, and wherein some of said conductor elements are filtered and others of said conductor elements are unfiltered; and a cable assembly including a cable and a plate member, said plate member supporting a plurality of contacts, said contacts making push-fit engagements at their forward ends with the rear ends of said conductor elements in said rear assembly, and said contacts being connected at their rear ends with respective wires in said cable, such that said rear assembly is removably interposed between said forward assembly and said cable assembly.

* * * * *